US006361403B1

(12) United States Patent
Kuramochi et al.

(10) Patent No.: US 6,361,403 B1
(45) Date of Patent: Mar. 26, 2002

(54) ABRASIVE MEMBER, ABRASIVE DISC PROVIDED WITH SAME, AND POLISHING PROCESS

(75) Inventors: Hideto Kuramochi, Yokohama; Yoshitaka Kubota, Sagamihara, both of (JP)

(73) Assignee: Tosoh Corporation, Yamaguchi (JP)

( * ) Notice: Subject to any disclaimer, the term of this patent is extended or adjusted under 35 U.S.C. 154(b) by 0 days.

(21) Appl. No.: 09/465,264

(22) Filed: Dec. 17, 1999

(30) Foreign Application Priority Data

Dec. 18, 1998 (JP) ..... 10-360465

(51) Int. Cl.[7] ..... B24B 1/00; B24D 3/02

(52) U.S. Cl. ..... 451/41; 451/526; 451/539; 51/308

(58) Field of Search ..... 451/526, 539, 451/540, 548, 41; 51/308, 307, 309, 295

(56) References Cited

U.S. PATENT DOCUMENTS

| | | | | | |
|---|---|---|---|---|---|
| 3,841,852 | A | * | 10/1974 | Wilder et al. | 51/295 |
| 4,157,387 | A | * | 6/1979 | Benedict | 428/54 |
| 4,543,106 | A | * | 9/1985 | Parekh | 51/295 |
| 4,997,461 | A | * | 3/1991 | Markhoff-Matheny et al. | 51/295 |
| 5,203,884 | A | * | 4/1993 | Buchanan et al. | 51/295 |
| RE35,570 | E | * | 7/1997 | Rowenhorst et al. | 51/293 |
| 5,653,775 | A | * | 8/1997 | Plovnick et al. | 51/309 |
| 5,667,567 | A | * | 9/1997 | Masumura et al. | 106/3 |
| 5,669,941 | A | * | 9/1997 | Peterson | 51/295 |
| 6,039,775 | A | * | 3/2000 | Ho et al. | 51/295 |
| 6,053,956 | A | * | 4/2000 | Wood | 51/309 |
| 6,080,216 | A | * | 6/2000 | Erickson | 51/309 |
| 6,120,353 | A | * | 9/2000 | Suzuki et al. | 451/41 |

FOREIGN PATENT DOCUMENTS

| | | |
|---|---|---|
| JP | A H6-39732 | 2/1985 |
| JP | A H5-154760 | 12/1991 |
| JP | A H7-326597 | 6/1994 |
| JP | A H9-22888 | 7/1995 |
| JP | A H10-1376 | 8/1996 |
| JP | A H10-72578 | 6/1997 |

* cited by examiner

*Primary Examiner*—Derris H. Banks
*Assistant Examiner*—Hadi Shakeri
(74) *Attorney, Agent, or Firm*—Sughrue Mion, PLLC

(57) ABSTRACT

An abrasive member made of a silica molding predominantly comprised of silica is described. The abrasive member has a bulk density of 0.2 to 1.5 g/cm$^3$, a BET specific surface area of 10 to 400 m$^2$/g, an average particle diameter of 0.001 to 0.5 $\mu$m, and a multiplicity of interconnecting minute pores which are open to the exterior. A solid soluble in a polishing liquid is made present within the minute pores of the silica molding. The abrasive member is fixed or fitted to a supporting auxiliary to be assembled into an abrasive disc. The abrasive disc is used for polishing a material to be polished, by rubbing the material to be polished therewith while at least one of the abrasive disc and the material to be polished is moved and while a polishing liquid is applied to the abrasive disc.

12 Claims, No Drawings

ABRASIVE MEMBER, ABRASIVE DISC PROVIDED WITH SAME, AND POLISHING PROCESS

BACKGROUND OF THE INVENTION (1) Field of the Invention

This Invention relates to a silica-based abrasive member, an abrasive disc provided with the abrasive member, and a process for polishing a material to be polished by using the abrasive disc.

The abrasive disc of the invention is useful for polishing or chemicomechanically polishing substrate materials such as a silicon wafer, oxide substrate materials such as lithium niobate and lithium tantalate, compound semiconductor substrates and glass substrates; and metals, silica glass and stone.

(2) Description of the Related Art

In conventional processes for polishing substrate materials, such as silicon wafer, oxide substrates, compound semiconductor substrates and a glass substrate, a loose abrasive polishing process has heretofore been employed wherein the substrate materials are polished with a polishing pad made of nonwoven fabric or suede cloth, while a polishing liquid comprising a loose grain such as colloidal silica and a chemical agent such as potassium hydroxide is continuously applied onto the polishing surface. For example, a process for polishing a silicon wafer by using a polishing cloth and a loose abrasive grain is described in Japanese Unexamined Patent Publication (hereinafter abbreviated to "JP-A") H5-154760 and JP-A H7-326597. In the conventional loose grain polishing process, a polishing liquid containing a large amount of a loose grain is used, and thus, a certain amount of a waste polishing liquid containing a loose grain is produced during polishing. Therefore, the efficiency of the polishing process, equipment for the waste disposal and the environmental pollution with the waste polishing liquid must be considered. The polishing pad such as polishing cloth tends to be clogged and the polishing performance is deteriorated, and thus, the polishing pad must be exchanged with considerable frequency and the polishing efficiency is decreased.

To solve the above problems, a proposal has been made in JP-A H6-39732 wherein a grinding stone for first polishing is used which is made by curing a slurry of an abrasive grain in a mixed liquid of a liquid phenolic resin and a liquid melamine resin. However, a problem of clogging still arises because the resins are not removed and are made present on the polished surface of a substrate material during polishing.

SUMMARY OF THE INVENTION

In order to solve the foregoing problems, the inventors have conducted research to utilize an abrasive silica molding in a polishing process as suggested in, for example, JP-A H10-1376, and made the following findings.

(1) An abrasive silica molding has a rough surface due to finely divided silica particles, and the silica particles are placed in direct contact with a substrate material to be polished, and thus, polishing can be effected by using a polishing liquid containing no loose grain such as colloidal silica. Further, the silica particles fall off from the abrasive silica molding only to a minimized extent, and thus, the problem of waste disposal can be mitigated.

(2) An abrasive silica molding has a relatively high tenacity and thus exhibits a relatively good durability. Therefore, polishing can be continued over a long period without exchange of the abrasive molding. In addition, the polishing can be carried out under a high pressure leading to shortening of polishing time.

(3) A surface finish equal to or better than those of the conventional polishing processes can be obtained. At a polishing rate equal to or higher than those of the conventional processes, a surface finish of the same quality can be obtained. Further, decrease of the polishing performance with time is minor.

(4) Even when a polishing liquid comprising a loose abrasive grain is used, a high polishing rate can be employed at an abrasive grain concentration lower than that in the conventional polishing processes.

However, an abrasive molding with which a more efficient polishing process can be employed and which exhibits an enhanced duration of life is still desired.

In view of the foregoing, an object of the present invention is to provide an abrasive member made of a silica molding, an abrasive disc having the abrasive member, and a polishing process using the abrasive disc, which are characterized by using a specific silica molding which is not easily damaged during polishing, abrasion of which is reduced, and by which the problem of waste disposal is mitigated.

In one aspect of the present invention, there is provided an abrasive member made of a silica molding predominantly comprised of silica, and having a bulk density of 0.2 to 1.5 g/cm$^3$, a BET specific surface area of 10 to 400 m$^2$/g, an average particle diameter of 0.001 to 0.5 $\mu$m, and a multiplicity of interconnecting minute pores which are open to the exterior; said abrasive member containing a solid within the minute pores of the silica molding, which solid is soluble in a polishing liquid.

In another aspect of the present invention, there is provided an abrasive disc comprising the above-mentioned abrasive member and a supporting auxiliary, to which the abrasive member is fixed.

In still another aspect of the present invention, there is provided a process for polishing a material to be polished, which comprises rubbing the material to be polished with an abrasive disc while at least one of the abrasive disc and the material to be polished is moved and while a polishing liquid is applied to the abrasive disc, wherein an abrasive disc having the above-mentioned abrasive member is used.

DETAILED DESCRIPTION OF THE PREFERRED EMBODIMENT

The abrasive member of the invention is made of a silica molding predominantly comprised of silica, and having a bulk density of 0.2 to 1.5 g/cm$^3$, a BET specific surface area of 10 to 400 m$^2$/g, an average particle diameter of 0.001 to 0.5 $\mu$m, and a multiplicity of interconnecting minute pores which are open to the exterior. The abrasive member contains a solid within the minute pores of the silica molding, which solid is soluble in a polishing liquid (said solid is hereinafter referred to as "soluble solid" for brevity).

Silica Molding

By the term "predominantly" used herein, we mean that the silica molding comprises at least 90% by weight of silica based on the weight of the silica molding. The content of silica can be expressed as a silica content as measured on a silica material which has been prepared by heat-treating a silica raw material such as a silica powder or soot at a temperature of 105° C. for 2 hours. The heat-treated silica material comprises silica, impurities and an ignition loss.

Usually the content of silica in the silica raw material for the preparation of the silica molding used in the invention is at least about 97% by weight based on the sum of silica and impurities. If the content of silica in the silica molding is not larger than 90% by weight, problems arise in that the material to be polished tends to be contaminated with impurities to a significant degree and deteriorated during polishing.

The silica molding predominantly comprised of silica is made, for example, by molding a silica powder which is a wet process silica (i.e., precipitated silica) powder prepared from sodium silicate, or a dry process silica prepared by vapor phase thermal decomposition of silicon tetrachloride, or by piling a fine silica powder directly into a molded form (usually called as soot), which powder is as-prepared by vapor phase thermal decomposition of silicon tetrachloride.

The bulk density of the silica molding is in the range of 0.2 to 1.5 g/cm$^3$. If the bulk density is too small, the abrasive member has poor durability and poor shape retention, and is abraded to an undesirably great extent during polishing. In contrast, if the bulk density is too large, the polished material has surface defects and the surface has a poor smoothness.

The BET specific surface area of the silica molding is in the range of 10 to 400 m$^2$/g. If the BET specific surface area is too large, the abrasive member has poor shape retention. In contrast, if the BET specific surface area is too small, the surface of polished material has poor smoothness.

The average particle diameter of the silica molding is in the range of 0.001 to 0.5 $\mu$m. A porous silica molding composed of particles with an average particle diameter smaller than 0.001 $\mu$m and having the desired properties is extremely difficult to prepare because a silica material with a primary particle diameter of not larger than 0.001 $\mu$m must be used. In contrast, a porous silica molding composed of particles with an average particle diameter larger than 0.5 $\mu$m tends to give a polished surface with surface defects.

The silica molding has a multiplicity of interconnecting minute pores which are open to the exterior. Minute pores having a diameter of several nm to several hundred $\mu$m are connected with each other to form substantially interconnected pores open to the exterior. Due to the open interconnecting minute pores, the silica molding is porous, and is not easily clogged during polishing and exhibits good polishing efficiency. It is to be noted that the abrasive member of the invention, made of the silica molding, contains a soluble solid within the interconnecting minute pores of the silica molding. Due to the soluble solid, the abrasive member has enhanced durability and the silica molding is not abraded to an undesirable extent during polishing. The soluble solid is dissolved little by little by a polishing liquid applied to the abrasive member, and thus, clogging of the silica molding can be prevented.

The porosity of the interconnecting minute pores, i.e., the ratio of the apparent volume of the interconnecting minute pores to the apparent volume of the silica molding, is preferably in the range of 30 to 95% by volume based on the total volume of the silica molding. If the porosity of the interconnecting minute pores is too small, the benefits brought by the soluble solid tend to be minimized. In contrast, if the porosity of the interconnecting minute pores is too large, the silica molding becomes poor in retention of shape.

The pore diameter distribution of the interconnecting minute pores is not critical, but is preferably such that the integrated pore volume of minute pores having a pore diameter of at least 1 $\mu$m is at least 20%, the integrated pore volume of minute pores having a pore diameter of 10 to 100 $\mu$m is at least 15%, and the integrated pore volume of minute pores having a pore diameter exceeding 100 $\mu$m is not larger than 5%, based on the total integrated pore volume in the silica molding.

When the integrated pore volume of minute pores having a pore diameter of at least 1 $\mu$m is at least 20%, based on the total integrated pore volume in the silica molding, clogging of the abrasive member does not occur or occurs only to a minimized extent, a high polishing efficiency can be attained over a long period, and frequency of changing of the abrasive member can be reduced.

These benefits become more prominent when the integrated pore volume of minute pores having a pore diameter of 10 to 100 $\mu$m is at least 15%, based on the total integrated pore volume in the silica molding. This is because minute pores having a pore diameter of at least 10 $\mu$m but smaller than 100 $\mu$m exhibit a function of minimizing clogging of the abrasive member, but this function is smaller than that of minute pores having a larger pore diameter. When minute pores having a pore diameter exceeding 100 $\mu$m are present in a large amount, the abrasive member tends to have a rough structure and uniform and precise polishing becomes difficult to attain. Thus, the integrated pore volume of minute pores having a pore diameter exceeding 100 $\mu$m is preferably not larger than 5%, based on the total integrated pore volume in the silica molding.

Soluble Solid

The soluble solid contained within the interconnecting minute pores of the silica molding is not particularly limited provided that the object of the invention can be achieved, but is preferably such that it is capable of being charged and retained in a solid form within the interconnecting minute pores, and is further capable of being dissolved little by little in the particular polishing liquid applied during a polishing process.

The soluble solid is selected from inorganic compounds and organic compounds, which are soluble in the particular polishing liquid used. Usually water is used as a polishing liquid, and thus, a water-soluble solid is used. As examples of the soluble solid, there can be mentioned (i) alkali metal hydroxides such as potassium hydroxide, sodium hydroxide and lithium hydroxide, and alkaline earth metal hydroxides such as magnesium hydroxide and calcium hydroxide; (ii) alkali metal salts such as lithium fluoride, sodium chloride and potassium chloride, alkaline earth metal salts, and hydrates thereof; (iii) resins including thermosetting resins, anaerobic setting resins, ultraviolet setting resins and thermoplastic resins, such as epoxy resins, acrylic resins and polyolefin resins, and adhesives including instantaneous adhesives including instantaneous setting type, contact setting type, ultraviolet setting type and anaerobic setting type adhesives, such as rubber adhesives, hot-melt adhesives, elastomer adhesives, emulsion adhesives, thermosetting adhesives and thermoplastic adhesives; (iv) waxes such as water-soluble waxes; (v) amines such as urea; and (vi) organic acids such as oxalic acid, malonic acid, malic acid, citric acid, lactic acid and tartaric acid. These soluble solids may be used either alone or as a combination of at least two thereof.

The soluble solids have a function of enhancing the durability of the silica molding. The soluble solids (i), (ii), (v) and (vi) have a function of enhancing the rate of polishing, in addition to the durability of the silica molding. More specifically when an alkali metal hydroxide or an alkaline earth metal hydroxide is used as a soluble solid, it is expected to have a benefit of an etchant in the case where, for example, a silicon wafer is polished, and it exhibits good polishing performance even in the case where a polishing liquid containing no alkali, such as distilled water, is used. An alkali metal salt, an alkaline earth metal salt or a hydrate thereof is used as a soluble solid, an alkali or alkaline earth metal ion dissociated therefrom is expected to have a mechanochemical action, and thus, polishing can be effected with a high efficiency even when a polishing liquid containing no loose abrasive grain is used. When an amine is used as a soluble solid for silicon wafer, the rate of polishing can be enhanced. When an organic acid is used as a soluble solid for polishing metal substrates and glass substrates.

The amount of the soluble solid is preferably such that it occupies at least 10% by weight based on the total volume of the interconnecting minute pores. If the amount of the soluble solid is too small, it would be difficult to attain the benefits of the soluble solid, i.e., the enhancement of durability of silica molding, the reduction of abrasion of silica molding, and the enhancement of polishing rate.

Process for Producing Abrasive Member

The process for producing the abrasive member of the invention will now be described.

First, the process for producing a silica molding of the abrasive member is not particularly limited provided that a silica molding having the above-specified properties is obtained. For example, the silica molding is made by press-molding a silica powder which is a wet process silica (i.e., precipitated silica) powder prepared from sodium silicate, or a dry process silica prepared by vapor phase thermal decomposition of silicon tetrachloride, or by molding a slurry of these silica powders. The thus-obtained molded products are usually sintered. The silica molding also can be made by piling a fine silica powder directly into a molded form (usually called as soot) which powder is as-prepared by vapor phase thermal decomposition of silicon tetrachloride.

More specifically, a powdery raw material can be pre-molded, followed by classification using a sieve. The pressure under which the raw material is pre-molded varies depending upon the particular properties of the powder, but is usually in the range of 5 to 1,000 kg/cm$^2$. To improve the moldability of the powdery raw material, it can be made into granules, for example, by a spray drying or rolling method, or a binder solution can be incorporated therein.

A pore-forming agent can be incorporated. As specific examples of the pore-forming agent, there can be mentioned waxes such as paraffin wax and microcrystalline wax, powdery acrylic resins such as polymethyl methacrylate and polybutyl methacrylate, powdery olefin resins such as polyethylene, polypropylene, an ethylene-vinyl acetate copolymer and an ethylene-ethyl acrylate copolymer, powdery polystyrene, powdery higher fatty acids such as stearic acid, powdery potato starch, powdery corn starch, powdery polyvinyl alcohol, powdery ethyl cellulose and powdery carbon. The procedure for incorporating the pore-forming agent in the silica granules is not particularly limited provided that the mixing can be carried out without breaking of granules. The incorporation can be carried out, for example, by dry-mixing using a V-shaped blender.

The procedure for molding a mixed powder of silica granule with a pore-forming agent is not particularly limited, and includes, for example, mechanical molding, hydrostatic molding, injection molding, extrusion molding and cast molding.

Silica moldings have made only from a powdery silica raw material can be used, as they are, for the abrasive member of the invention. However, silica moldings made by using a binder or a pore-forming agent can be subjected to a post-treatment, for example, heat-degressing, firing or sintering and/or machining. The post-treatment procedure is not particularly limited provided that a mechanical strength sufficient for withstanding the polishing is given. Usually an organic binder and an organic pore-forming agent are incorporated in the raw material to enchance the moldability, and therefore, it is preferable that heat-degressing is carried out before the firing or sintering. The degreasing procedure is not particularly limited and includes, for example, heating in an air atmosphere, or heating under an inert gas atmosphere such as nitrogen, argon or helium. The pressure of the gaseous atmosphere may be chosen from a board range spanning from vacuum to a high pressure. Alternatively, to improve the moldability, it is possible that water is incorporated in the powdery raw material, and the molded product is dried before firing or sintering.

The molded product from which a binder or pore-forming agent has been removed is preferably fired or sintered to improve its strength and durability of an abrasive disc made therefrom. Other means may also be employed.

The process by which a soluble solid is charged within interconnecting minute pores of the thus-made silica molding to produce the abrasive member of the invention is not particularly limited. As examples of the process for charging a soluble solid, there can be mentioned a process wherein a vaporizable soluble solid is vaporized at a high temperature and/or under a reduced pressure, the vaporized soluble solid is passed alone or together with an inert gas through the interconnecting minute pores where the vaporized soluble solid is cooled to be thereby deposited within the minute pores; a process wherein the silica molding is impregnated with a solution or slurry of a soluble solid, and then the solvent is removed to produce a precipitate of the soluble solid; a process wherein the silica molding is coated with a solution or slurry of a soluble solid, and then the solvent is removed to produce a precipitate of the soluble solid; and a process wherein the silica molding is placed in contact with a solution or slurry of a soluble solid under a pressure, and then the solvent is removed to produce a precipitate of the soluble solid. The silica molding can be placed under a reduced pressure to deaerate the minute pores before charging a soluble solid therein. The solvent used for preparing the solution or slurry, the conditions for vaporization, and the temperature, pressure and time conditions for charging are not particularly limited, and known solvents and conditions may be employed.

Abrasive Disc

An abrasive disc is made by assembling the above-mentioned abrasive member and a supporting auxiliary. The supporting auxiliary used includes, for example, metal plates and other shaped parts. The material and shape of the supporting auxiliary, and the assembling procedure are not particularly limited. Usually the abrasive member is fixed to the supporting auxiliary by a procedure such as an adhering procedure using an adhesive, for example, an elastomer adhesive, a thermoplastic adhesive or a thermosetting adhesive, or a procedure of fitting the abrasive member into a recess formed on the supporting auxiliary. Since the abrasive member has interconnecting minute pores charged with a soluble solid, the abrasive member can be closely adhered to the supporting auxiliary, and the deviation of the abrasive member from the right position on the supporting auxiliary occurring due to loading or vibration can be prevented, which leads to enhancement of precision of polishing.

When an adhesive is used for fixing the abrasive member to the supporting axuliary, care should preferably be taken so as to choose an adhesive causing no crazing or cracking of the abrasive member, such as an elastomer adhesive.

The supporting auxiliary having the abrasive member fixed thereto is fitted to a polishing apparatus by fitting directly the supporting auxiliary to the polishing apparatus, or fixing the supporting auxiliary to a rotational member provided in the polishing apparatus by means of adhesion, embedding or screwing. The manner in which the supporting auxiliary is fixed or fitted to the polishing apparatus is not particularly limited, and varies depending upon the structure and shape of the supporting auxiliary.

The number of the abrasive members fixed to the supporting auxiliary is not particularly limited, but preferably at least two abrasive members are fixed. When polishing is effected by using a disc having a plurality of abrasive members fixed to the supporting auxiliary in an arrangement such that a polishing liquid applied is discharged through drainage conduits formed between the adjacent abrasive members, the polishing rate can be increased. Further, the abrasive member is brought into uniform contact with the entirety of the material to be polished, and uniform polishing can be effectively conducted. When a disc having one abrasive member fixed to the supporting auxiliary is used, it is preferably that a conduit for draining a polishing liquid is formed on the polishing surface.

The shape of the abrasive member is not particularly limited and includes, for example, a columnar pellet and a square pillar shaped pellet having a triangular or quadrilateral cross-section.

The size of the abrasive member also is not particularly limited provided that a desired number of the abrasive members are capable of being fixed to a supporting auxiliary. Preferably the size is to an extent such that each abrasive member falls within a square area having a side length of 5 to 100 mm. Thus, an abrasive member of a columnar pellet shape preferably has a diameter of 5 to 100 mm and that of a square pillar shape preferably has a side length of 5 to 100 mm. Even if the size of the abrasive member is smaller than 5 mm, it has a good polishing performance, but, when an abrasive disc of a large size is used, too many abrasive members must be used to obtain polishing efficiency of an acceptable extent and thus the abrasive member has poor practicality. Even if the size of the abrasive member is larger than 100 mm, the abrasive disc exhibits a polishing performance of an acceptable extent provided that conduits for draining a polishing liquid are formed on the abrasion surface, but, the number of the abrasive members per unit area of a support must be small and it may be difficult to attain uniform polishing.

The thickness (i.e., length perpendicular to the abrasion surface) of the abrasive member is not particularly limited, but is preferably in the range of 3 to 10 mm. At a thickness smaller than 3 mm, it is troublesome to exchange the abrasive member. In contrast, at a thickness exceeding 10 mm, it becomes difficult to uniformly apply a polishing liquid over the abrasion member.

The distribution of the abrasive members in an abrasive disc is not particularly limited provided that the abrasive members are substantially uniformly distributed over the entire usable area of the surface of the supporting auxiliary. However, in order to obtain a good polishing efficiency for various types of materials to be polished and for any part of the material, it is preferable that the abrasive members are symmetrically distributed relative to a centerline drawn on the usable area of the surface of the auxiliary support, or distributed on concentric circles on the usable area of the surface of the auxiliary support.

The number of abrasive members fitted to a supporting auxiliary is not particularly limited and varies depending upon the size of abrasive members, the usable area of the supporting auxiliary to which the abrasive members are fitted, and the size of an abrasive disc. Preferably the number of abrasive members is such that the ratio of the total area of the polishing surfaces of the abrasive members to the total usable area on the surface of the supporting auxiliary is not larger than 95%. By the phrase "the total area of the polishing surfaces of the abrasive members" we mean the total of the areas on the abrasive members, which are placed in contact with the material to be polished. If this ratio is larger than 95%, the rate of polishing is reduced to a level similar to the case where one abrasive member is fitted to a supporting auxiliary, and thus, the abrasive disc is inferior to that having two or more abrasive members. The minimum permissible ratio is not particularly limited, but, is usually about 30%. At a ratio of smaller than about 30%. the usable area of the polishing surface of the abrasive members is small.

Abrasive members can be fixed to an auxiliary to make an abrasive disc, as explained above. Alternatively abrasive members can be directly fitted to a rotational part of a polishing apparatus.

The shape of the abrasive disc used is usually such that it has a flat surface similar to the surface to be polished of the material, but, various shapes can be employed, which include, for example, flat-square, disc-form, ring-form or cylindrical form.

Polishing Process

In the polishing process of the invention, the above-mentioned abrasive disc having at least one abrasive member is used. The polishing conditions under which the abrasive disc is used and the polishing liquid are not particularly limited and may be conventional. For example, an aqueous alkali solution such as an aqueous potassium hydroxide solution can be used as a polishing liquid. The temperature of the polishing liquid may be any of the temperatures lower than the boiling point. The pressures applied for polishing can be, for example, in the range of about 100 to about 500 gf/cm$^2$, which are the same as that employed in the conventional polishing using a polishing cloth. A higher pressure can be employed, at which the conventional polishing could not be effected without undue abrading of the corner portions of the material to be polished. Usually the pressure can be up to 1,000 gf/cm$^2$.

The polishing is effected by using the abrasive member having an enhanced duration of life instead of a polishing cloth in the conventional polishing process, and therefore, frequency of exchange of the abrasive member can be reduced and the polishing efficiency is enhanced. Further, a polishing liquid containing a minor amount of loose abrasive grains, or not containing loose abrasive grains, can be used and therefore, the problem of waste disposal can be mitigated or avoided. When the polishing liquid used is an aqueous liquid, it is preferably such that the waste polishing liquid has a light transmission of at least 10% at a wavelength of 600 nm.

As examples of the material to be polished, there can be mentioned substrate materials including compound semiconductor substrates such as silicon wafer, gallium phosphorus substrate, gallium arsenic substrate, oxide substrates such as substrates of lithium niobate, lithium tantalate and lithium borate, and silica glass substrate; silica glass plates; metallic materials; and building stones. The abrasive disc of the invention is useful for polishing or chemicomechanically polishing these materials.

The invention will now be described by the following examples that by no means limit the scope of the invention.

Properties of abrasive members and abrasive discs were evaluated by the following methods.

(1) Bulk Density of Silica Molding

A sample of abrasive molding with a plate-form having a size of 100 mm×100 mm×15 mm (thickness) is prepared. The sample weight is measured by an electronic force balance and the dimensions are measured by a micrometer. The bulk density (g/cm$^3$) is calculated from the weight and dimensions of the sample.

(2) BET Specific Surface Area of Silica Molding

A sample of silica molding is pulverized and the resulting powder is tested. Specific surface area (cm$^2$/g) is measured by a BET monadic method using a testing apparatus "MONOSORB" supplied by Quantachrome Co., U.S.A.

(3) Average Particle Diameter of Silica Molding

A part of a sample of silica molding is observed by a scanning electron microscope "ISI DS-130" supplied by Akashi Seisakusho K. K. The average particle diameter ($\mu$m) is calculated by an interceptive method.

(4) Pore Diameter Distribution of Silica Molding

Porosity of a silica molding is measured by a method using a mercury porosimeter ("Poresizer 9320" supplied by Shimadzu Corp.) while mercury is penetrated therein at a pressure varying from 0 to 270 MPa. That is, mercury is forced to penetrate into pores in the silica molding under the specified pressure, and the pore diameter distribution is determined by calculation of the minimum pore diameter into which mercury is penetrated at a stated pressure and the total volume of pores with a diameter of equal to and larger than the minimum pore diameter, from the integrated volume of penetrated mercury and the applied pressure according to the Washburn formula. Usually the calculated pore diameter and the integrated pore volume are calibrated depending upon the surface tension of mercury, the contact angle and the measuring apparatus.

(5) Porosity of Silica Molding

A columnar sample having a diameter of 25 mm and a thickness of 10 mm is prepared. The sample is immersed in a water bath and the water is boiled whereby the sample is impregnated with water. The sample is allowed to stand until the temperature reaches room temperature. Then the sample is taken out and water on the outer surface is wiped off. The pore volume $V_p$ is determined from the increase in weight of the sample saturated with water. The porosity (%) of silica molding is calculated from $V_p$ and the volume $V_a$ of sample by the following equation (1).

$$\text{Porosity } (\%)=(V_p/V_a)\times 100 \quad (1)$$

(6) Filling Ratio of Soluble Solid in Pores of Silica Molding

The dimensions and weight $W_g$ of a sample of silica molding is measured. The sample is impregnated with a solution of a soluble solid, and then dried. The weight $W_a$ of the dried sample is measured. The volume V of the soluble solid in the pores is calculated from $W_a$, $W_a$ and specific gravity d of the soluble solid by the following equation (2).

$$V=(W_a-W_a)/d \quad (2)$$

The filling ratio (%) of the soluble solid in pores is calculated from the volume V of soluble solid and the volume $V_p$ of pores by the following equation (3).

$$\text{Filling ratio } (\%)=(V/V_p)\times 100 \quad (3)$$

(7) Compressive Strength of Silica Molding

A sample of silica molding with a plate-form having a size of 10 mm×10 mm×7 mm (thickness) is prepared. The compressive strength (kg/cm$^2$) is measured according to JIS-R-1608 by using "SHIMADZU Autograph IS-10T" supplied by Shimadzu Corp. while a load is applied at a cross head speed of 0.5 mm/min.

(8) Surface State of Polished Surface

A columnar silica molding with a diameter of 25 mm and a thickness of 5 mm having the characteristics shown in Table 2 is impregnated with a soluble solid within the pores to prepare a columnar sample. 100 pieces of the columnar sample are fitted to a rotational lower disc having a diameter of 300 mm of a polishing apparatus "PLANOPOL/PEDEMAX 2" supplied by Struers Co. in a manner such that the polishing surfaces of samples form a flat surface.

A square silicon wafer is prepared by cutting a single crystal silicon ingot to give a disc, lapping both surfaces of the disc to give a disc having a maximum height Rmax of about 3 $\mu$m, and cutting the disc into a square form having a size of 45 mm×45 mm. The silicon wafer is polished by using the silica molding-fitted disc at a lower disc revolution of 150 rpm and a pressure of 250 g/cm$^2$. During polishing, an aqueous potassium hydroxide solution (temperature: 30° C., pH=10.8) as a polishing liquid is dropped at a rate of 100 ml/min onto the polishing surface. The polishing is continued to an extent such that the wafer thickness is reduced by 10 $\mu$m. The surface state of the polished surface is observed by an optical microscope "BH-2" supplied Olympus Optical Co. The results are expressed by the following two ratings.

Rating A: the polished surface is very smooth and there is no scratch.

Rating B: the surface is not smooth and cannot be uniformly abraded.

(9) Surface Precision of Polished Surface

The surface precision of a polished surface is evaluated by using a universal surface tester "SE-3C" supplied by Kosaka Kenkyusho K. K. More specifically the center line average surface roughness (Ra) and the maximum height (Rmax, $\mu$m) are measured at a cut off value of at least 0.8 mm and a measurement length of 2.5 mm according to JIS-B-601. A measurement length (L) of the center line of a roughness curve is taken, and, assuming that the center line is "x" axis and a line perpendicular to the "x" axis is "y" axis, and the roughness curve (y) is expressed by the formula: y=f(x), the center line average roughness (Ra) is expressed by the following equation (4):

$$Ra(\mu\text{m})=(1/L)\int_1^L |f(x)|dx \quad (4)$$

The maximum height (Rmax) is determined as follows. A standard length is taken from the surface cross-section line, and the taken cross-section line is sandwiched between two parallel straight lines. The distance between the two parallel straight lines is the maximum height (Rmax, $\mu$m).

(10) Durability of Silica Molding

Polishing is continued by using an abrasive silica disc sample. When 90 hours elapse, the presence of cracks, crazes and other surface defects on the polishing surfaces of abrasive members and the slipping out of place of fixed or fitted abrasive members or silica moldings are observed by the nake eye. The durability of the silica disc sample is expressed by the number of the surface defects and the number of the slipped abrasive members.

(11) Abrasion of Silica Molding

When a stated time elapses, the thickness of abrasive silica molding is measured. The reduction in thickness is expressed by μm per unit time. The smaller the thickness reduction, the smaller the abrasion of the abrasive silica molding.

Production of Abrasive Member and Evaluation Thereof

Example 1

A powdery raw material of precipitated silica, prepared by a wet process and having the characteristics shown in Table 1, was mixed with a binder and water to obtain an aqueous slurry. The aqueous slurry was spray-dried to obtain granules. A binder was incorporated in the granules to a powdery raw material for molding. The powdery raw material was molded and the obtained molding was fired in a furnace to obtain a silica molding. The bulk density, BET specific surface area, average particle diameter, porosity, pore diameter distribution and compressive strength of the silica molding were evaluated. The results are shown in Table 1.

The silica molding was impregnated with an aqueous solution of a water-soluble wax ("WA-302" supplied by Nikka Seikou K. K.), and the impregnated silica molding was dried to obtain an abrasive member having a water-soluble wax within the interconnecting minute pores. The bulk density and compressive strength of the abrasive member and the filling ratio of the water-soluble wax in the pores of the abrasive member were evaluated. The results are shown in Table 1.

The abrasive member was fixed to a disc of a polishing apparatus, and a polishing test was conducted. The surface state and surface precision of the polished surface, and the durability and reduction in thickness of the abrasive member were evaluated. The results are shown in Table 2.

Comparative Example 1

An abrasive member was made by the same procedures as described in Example 1 except that the silica molding was not impregnated with the water-soluble wax. The abrasive member was fixed to a disc of a polishing apparatus, and a polishing test was conducted in the same manner as described in Example 1. The results are shown in Table 2.

TABLE 1

| | | Example 1 | Com. Ex. 1 |
|---|---|---|---|
| Composition of powdery silica raw material | | | |
| Silica content | (wt. %) | 95 | 95 |
| Impurities | (wt. %) | | |
| Water | | 5 | 5 |
| Ignition loss | | 3.9 | 3.9 |
| $Al_2O_3$ | | 0.52 | 0.52 |
| $Fe_2O_3$ | | 0.05 | 0.05 |
| $TiO_2$ | | 0.08 | 0.08 |
| CaO | | 0.02 | 0.02 |
| MgO | | 0.01 | 0.01 |
| $Na_2O$ | | 0.43 | 0.43 |
| Silica molding | | | |
| Bulk density | ($g/cm^3$) | 0.46 | 0.46 |
| BET specific surface area | ($m^2/g$) | 17 | 17 |
| Average particle diameter | (μm) | 0.16 | 0.16 |
| Porosity | (%) | 77.3 | 77.3 |
| Integrated volume: | | | |
| pores with diameter ≧1 μm | (%) | 31 | 31 |
| pores with diameter 10–100 μm | (%) | 23 | 23 |
| pores with diameter >100 μm | (%) | 0.6 | 0.6 |
| Compressive strength | ($kg/cm^2$) | — | 20.0 |

TABLE 1-continued

| | | Example 1 | Com. Ex. 1 |
|---|---|---|---|
| Abrasive member | | | |
| Bulk density | ($g/cm^3$) | 0.72 | — |
| Filling ratio | (%) | 27.5 | — |
| Compressive strength | ($kg/cm^2$) | 27.2 | — |

Comparative Example 2

A polishing pad "SUBA-600" supplied by Rodel Co. was adhered to a rotational lower disc of a polishing apparatus "PLANOPOL/PEDEMAX-2" supplied by Struers Co. A square silicon wafer having a size of 45 mm×45 mm was polished by the polishing pad-adhered disc at a lower disc revolution of 150 rpm and a pressure of 250 $g/cm^2$. During polishing, an aqueous slurry prepared by dissolving a commercially available abrasive compound "NALCO-2350" supplied by Rodel Co. in distilled water (temperature: 30° C., pH=10.8) as a polishing liquid is dropped at a rate of 100 ml/min onto the polishing surface. The evaluation results are shown in Table 2.

TABLE 2

| | Example 1 | Com. Ex. 1 | Com. Ex. 2 |
|---|---|---|---|
| State of polished surface | A | A | A |
| Center line average roughness (Ra) | 0.006 | 0.006 | 0.006 |
| Max. height (Rmax) | 0.04 | 0.04 | 0.04 |
| Durability *1 | 2 | 32 | — |
| Molding abrasion *2 (μm/hr) | 0.16 | 0.73 | — |

*1 Number of surface defects and slipped abrasive members
*2 Abrasion of molding during polishing (reduction of thickness)

As seen from Table 2, an abrasive disc provided with the abrasive member of the invention having a soluble solid within interconnecting minute pores therein exhibits enhanced duration of life and reduced abrasion (Example 1) as compared with an abrasive disc with an abrasive member not having a soluble solid (Comparative Example 1).

Evaluation of waste polishing liquid

Example 2

Using the abrasive member prepared in Example 1, a polishing test was conducted by the same procedures employed for the evaluation of "surface state of polished surface". The transparency of the waste polishing liquid was evaluated by using a spectrophotometer "Ubest-55" supplied by Nippon Bunko K. K. at a wavelength of 600 nm. The transparency was expressed as a value relative to purified water. When the transparency is high, the amount of loose grains in the waste polishing liquid is small. When the transparency is low, the amount of loose grains therein is large.

Comparative Example 3

The waste polishing liquid produced in the polishing test conducted in Comparative Example 2 was evaluated in the same manner as in Example 2. The results are shown in Table 3.

TABLE 3

| | Example 2 | Com. Ex. 3 |
|---|---|---|
| Transparency (%) | 82 | 1 |

As seen from Table 3, the waste polishing liquid produced in the polishing process using the abrasive member of the invention exhibits a very high transparency and thus, the amount of loose grains in the waste polishing liquid is very small.

The benefits of the abrasive member of the invention are summarized as follows.

(1) Due to the presence of a soluble solid within interconnecting minute pores of a silica molding used in the invention, a load for friction applied to the abrasive member of the invention can be mitigated, and abrasion of the silica molding is minimized. Therefore, the abrasive member is not damaged, and, even if damage is caused, the damage is only to a small degree and the frequency of exchange can be minimized.

(2) By filling the interconnecting minute pores of the abrasive member, the duration of life thereof is enhanced, and therefore, a high polishing pressure can be applied. In addition, the pressure can be applied uniformly over the entirety of the polishing surface and therefore the polishing time can be shortened.

(3) The minute pores in which a soluble solid is placed are interconnecting and open to the exterior, and therefore, the soluble solid is dissolved little by little in a polishing liquid applied during polishing. Therefore clogging on the surface of abrasive member is avoided and a sharp edge of the abrasive member is retained. Further, the duration of life of the abrasive member and the polishing efficiency are enhanced.

(4) The silica molding usually has a three-dimensional network structure comprised of silica particles. Therefore, even when the entire amount of soluble solid is dissolved, the abrasive member exhibits good retention of shape and polishing can be continued over a long period of time.

(5) The silica molding has open minute pores on the surface thereof and thus the surface is very rough. If a soluble solid is not present within the open minute pores, where the silica molding is directly adhered or fitted to a supporting auxiliary, the molding is difficult to closely contact with the supporting auxiliary. In contrast, the abrasive member of the invention has a soluble solid within the open minute pores on its surface, and thus, the surface is relatively smooth and can be closely contacted with the supporting auxiliary. Therefore, the abrasive member does not slide from the proper position on the supporting auxiliary during polishing, which leads to enhancement of polishing efficiency and reduction of damage of the abrasive member.

What is claimed is:

1. An abrasive member made of a silica molding predominantly comprised of silica particles, which silica particles have an average particle diameter of 0.001 to 0.5 $\mu$m, and which abrasive member has (i) a bulk density of 0.2 to 1.5 g/cm$^3$, (ii) a BET specific surface area of 10 to 400 m$^2$/g and (iii) a multiplicity of interconnecting minute pores which are open to the exterior; said abrasive member containing a solid within the minute pores of the silica molding, which solid is soluble in a polishing liquid.

2. An abrasive member according to claim 1, wherein a porosity of the interconnecting minute pores is in a range of 30 to 95% by volume based on a total volume of the silica molding.

3. An abrasive member according to claim 2, wherein the interconnecting minute pores of the silica molding have a pore diameter distribution such that an integrated pore volume of minute pores having a pore diameter of at least 1 $\mu$m is at least 20%, an integrated pore volume of minute pores having a pore diameter of 10 to 100 $\mu$m is at least 15%, and an integrated pore volume of minute pores having a pore diameter exceeding 100 $\mu$m is not larger than 5%, based on a total integrated pore volume of the minute pores in the silica molding.

4. An abrasive member according to claim 1, wherein the solid soluble in a polishing liquid occupies at least 10% by volume of a total volume of an interconnecting minute pores of the silica molding.

5. An abrasive disc comprising an abrasive member and a supporting auxiliary, to which the abrasive member is fixed; said abrasive member being made of a silica molding predominantly comprised of silica particles, which silica particles have an average particle diameter of 0.001 to 0.5 $\mu$m, and which abrasive member has (i) a bulk density of 0.2 to 1.5 g/cm$^3$, (ii) a BET specific surface area of 10 to 400 m$^2$/g and (iii) a multiplicity of interconnecting minute pores which are open to the exterior; said abrasive member containing a solid within the minute pores of the silica molding, which solid is soluble in a polishing liquid.

6. An abrasive disc according to claim 5, wherein a porosity of the interconnecting minute pores is in a range of 30 to 95% by volume based on a total volume of the silica molding.

7. An abrasive disc according to claim 6, wherein the interconnecting minute pores of the silica molding have a pore diameter distribution such that an integrated pore volume of minute pores having a pore diameter of at least 1 $\mu$m is at least 20%, an integrated pore volume of minute pores having a pore diameter of 10 to 100 $\mu$m is at least 15%, and an integrated pore volume of minute pores having a pore diameter exceeding 100 $\mu$m is not larger than 5%, based on a total integrated pore volume in the silica molding.

8. An abrasive disc according to claim 5, wherein the solid soluble in a polishing liquid occupies at least 10% by volume of a total volume of the minute pores of the silica molding.

9. A process for polishing a material to be polished, which comprises rubbing the material to be polished with an abrasive disc while at least one of the abrasive disc and the material to be polished is moved and while a polishing liquid is applied to the abrasive disc; said abrasive disc comprising an abrasive member and a supporting auxiliary to which the abrasive member is fixed; said abrasive member being made of a silica molding predominantly comprised of silica particles, which silica particles have an average particle diameter of 0.001 to 0.5 $\mu$m, and which abrasive member has (i) a bulk density of 0.2 to 1.5 g/cm$^3$, (ii) a BET specific surface area of 10 to 400 m$^2$/g and (iii) a multiplicity of interconnecting minute pores which are open to the exterior; said abrasive member containing a solid within the minute pores of the silica molding, which solid is soluble in the polishing liquid.

10. A polishing process according to claim 9, wherein a porosity of the interconnecting minute pores is in a range of 30 to 95% by volume based on a total volume of the silica molding.

11. A polishing process according to claim 10, wherein the interconnecting minute pores of the silica molding have a pore diameter distribution such that an integrated pore volume of minute pores having a pore diameter of at least 1 μm is at least 20%, an integrated pore volume of minute pores having a pore diameter of 10 to 100 μm is at least 15%, and an integrated pore volume of minute pores having a pore diameter exceeding 100 μm is not larger than 5%, based on a total integrated pore volume of the minute pores in the silica molding.

12. A polishing process according to claim 10, wherein the solid soluble in the polishing liquid occupies at least 10% by volume of a total volume of the minute pores of the silica molding.

* * * * *